US006454368B1

(12) United States Patent
Bedau et al.

(10) Patent No.: US 6,454,368 B1
(45) Date of Patent: Sep. 24, 2002

(54) LEADTHROUGH ADAPTER FOR SWITCH CABINETS

(75) Inventors: Norbert Bedau, Roth; German Kager, Oberaurach-Kirchaich; Alexander Schuir, Bamberg; Karl Schlichtig, Bischberg, all of (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 09/719,517

(22) PCT Filed: Jun. 11, 1999

(86) PCT No.: PCT/EP99/04018

§ 371 (c)(1),
(2), (4) Date: Feb. 26, 2001

(87) PCT Pub. No.: WO99/66606

PCT Pub. Date: Dec. 23, 1999

(30) Foreign Application Priority Data

Jun. 13, 1998 (DE) ..... 198 26 453

(51) Int. Cl.[7] ..... A47B 97/00
(52) U.S. Cl. ..... 312/223.1
(58) Field of Search ..... 312/223.1, 223.2, 312/223.6, 265.1, 265.4, 265.5; 174/50, 65 R; 439/540.1, 544, 545, 559

(56) References Cited

U.S. PATENT DOCUMENTS

| | | | | |
|---|---|---|---|---|
| 3,341,268 A | * | 9/1967 | Bickford | 312/223.1 X |
| 4,861,282 A | | 8/1989 | Kobayashi et al. | 439/540.1 |
| 5,002,502 A | | 3/1991 | Hill | 439/536 |

FOREIGN PATENT DOCUMENTS

| | | |
|---|---|---|
| DE | 30 00 349 | 7/1980 |
| DE | 90 03 879 | 6/1990 |
| DE | 43 29 994 | 3/1995 |
| EP | 0 663 782 | 7/1995 |
| FR | 2 582 159 | 11/1986 |
| WO | 96/28861 | 9/1996 |

* cited by examiner

*Primary Examiner*—James O. Hansen
(74) *Attorney, Agent, or Firm*—Venable; Gabor J. Kelemen; Catherine M. Voorhees

(57) ABSTRACT

A leadthrough adapter for connecting the components installed in a switchgear cabinet to external electric conductors. The adapter is located in a wall of the switchgear cabinet housing and one or more bushings are situated on the face of the adapter. The bushings can be accessed from the outside of the switchgear cabinet and plug-in connectors can be inserted into the bushings in order to connect the external electric conductors. Electric and/or electronic functional parts for the components that are accommodated inside the switchgear cabinet are arranged directly on the back of the adapter which faces towards the inside of the switchgear cabinet.

17 Claims, 12 Drawing Sheets

LEADTHROUGH ADAPTER FOR SWITCH CABINETS

BACKGROUND OF THE INVENTION

The problem encountered in switch cabinets is that the components built into the cabinet must be connected with electrical lines outside of the cabinet; in other words, the "insides" must be connected to the "outside world." A particular problem in this connection is the necessity of configuring housings, especially switch-cabinet housings, in accordance with the standard IEC 529, namely such that moisture and/or foreign objects cannot enter, in an effort to prevent damage to the components housed in the switch cabinet. In this connection, the degree of protection IP 54 included in the aforementioned standard establishes particularly high requirements.

According to the state of the technology, screw terminals or series terminals, to which the electrical conductors led from the outside into the switch cabinet are connected, are provided in the cabinet for connecting the "insides" of the cabinet to the "outside world." From the terminals, the individual lines lead to the different components housed in the switch cabinet. The electrical lines led into the switch cabinet from the outside are led through bores in one or more side walls of the cabinet and guided up to the screw or series terminal. For additional sealing, the bores are provided with rubber grommets or similar sealing elements. A disadvantage of this is that the switch cabinet must be opened for connecting the external lines. A further disadvantage is that the person tasked with connecting the lines must be very familiar with the internal layout of the switch cabinet to ensure that the correct conductor is always connected to the correct terminal input. This setup also requires a certain amount of manual dexterity—particularly under unfavorable circumstances, such as cramped conditions or the presence of moisture—for guiding the conductors into the terminal so as to assure a durable, reliable terminal connection.

A further problem associated with the known switch cabinets according to the state of the technology is that connecting the external lines with the aid of plug couplings is hardly possible. While it is possible to substitute a multipoint connector or edge socket connector for the terminal strip disposed inside the switch cabinet, the problem that arises is that the leadthrough bores in the cabinet walls are kept as small as possible to make the passageway for the external lines subsequently as impenetrable as possible to moisture and dirt; these bores are therefore typically much too small for leading through ready-made lines equipped with plugs or bushings. This means that, in the use of plug couplings, the external lines must be guided through the cabinet wall in a first work cycle, and the plug or bushing elements are then mounted on the line ends in a second, on-site work cycle, so the corresponding coupling can then be inserted.

Finally, for connecting external, ready-made lines that have plugs or bushings to switch cabinets, it is known from the state of the technology to arrange corresponding coupling parts directly in the housing bores so that lines can be led further from these couplings to the aforementioned screw terminals or terminal strips, or the desired components in the switch cabinet can be actuated directly.

It is known from U.S. Pat. No. 5,002,502, for example for antenna connections to satellite receivers, to cut holes into a device wall and arrange a board having coupling elements in the corresponding wall opening. Plugs that are fixed to conductors can be inserted onto the coupling elements, both from the outside and inside of the wall. For additional sealing, the coupling elements are provided with outside threads, onto which the plugs can be tightly fixed with the aid of union nuts. A disadvantage of this is the extremely complex design of the coupling elements or plugs. A further drawback is the fact that the same number of coupling elements as wall openings is provided on both sides of the board having the coupling elements, so there is always a 1:1 plug connection, that is, a coupling-plug combination on the outside of the device and a respective associated coupling-counterplug combination inside the device. According to the state of the technology, the board having the coupling elements is only an opening for guiding the external lines into the device interior. It is therefore necessary to provide further electrical or electronic functional parts in the switch cabinet to connect the lines, both in terms of conduction and function, to the components disposed in the cabinet.

DE-U 90 03 879 discloses a cable-plug distributing box having a plug bushing for a plug on the outside. To achieve a flat construction, the plug bushing is disposed on an intermediate board, which is in turn oriented perpendicular to a main board, so the insertion direction of the plug extends perpendicular to the main board. For the exit of the lines, individual contact sheets, to which the outgoing lines are connected individually, are disposed on the side opposite the plug bushing.

EP 0 663 782 A1 discloses a distributing cabinet that is designed for the connection of an external network to an internal network. For this purpose, it has a so-called routing distributor, which is held to pivot inside the distributing cabinet. The lines of both the internal and external networks are guided to modules embodied with plug bushings on the rear side of the routing distributor, with the individual lines of the external network being appropriately connected to those of the internal network.

SUMMARY OF THE INVENTION

In view of the problems outlined at the outset, it is the object of the invention to embody a leadthrough adapter for a switch cabinet to permit the external lines to be connected easily, assure the impermeability to moisture and foreign objects according to the degree of protection IP 54 pursuant to IEC 529, and improve the function of the adapter. This object is accomplished in a simple, inventive manner with the present invention.

The concept underlying the invention is to mount plugs onto the ends of the external lines provided for connecting to the switch cabinet; the plugs can be inserted simply into a bushing strip on the cabinet that has a complementary embodiment. To permit the use of ready-made plugs, the bushing strip is simply mounted to the outside of a housing wall of the switch-cabinet housing. The bushings into which the plugs can be inserted to produce a plug coupling are then mounted on the front side of the adapter mounted on the outside of the cabinet housing. Disposed on the rear side of the adapter, which faces the interior of the switch cabinet, are elements for connecting the components housed inside the cabinet to the adapter. These elements for connecting the components housed in the switch cabinet encompass electrical or electronic functional parts, in the form of connecting elements, for the components that are disposed inside the switch cabinet, the parts being positioned directly on the rear side of the adapter. The connecting elements have plug-and-socket connectors with varying embodiments for the components. The plug-and-socket connectors are embodied as system plug-and-socket connectors, such as keyed plug connectors, flat-line plug-and-socket connectors or latch-5 plug connectors. The plug-and-socket connectors are preferably compatible with the plug-and-socket connections on the components. Thus, the external lines and the "insides" of the switch cabinet can be connected easily via plug connections. In comparison to the state of the technology, however, there is no 1:1 plug connection; instead, an arbitrary number and type of input plug connections can be combined with a likewise arbitrary number and type of different output plug connections.

It is also advantageously possible with the invention to provide different electrical or electronic structural elements directly on the adapter, such as signal converters, display devices or separating devices. It is particularly advantageous to be able to mount fuse elements, such as overcurrent switches or other safeguards, near the switch-cabinet housing, and thus near the plugs. The power pack for supplying voltage to the switch cabinet can just as easily be disposed on the rear side of the leadthrough adapter. If, for example, an overcurrent switch trips, or an error occurs at the power pack, removing the adapter from the housing wall can immediately remedy the damage without necessitating the opening of the switch cabinet.

A further advantage is the elimination of a strict 1:1 plug connection according to the state of the technology. This strict 1:1 plug connection is replaced by an integral design of connecting elements and, simultaneously, structural elements. In the region of the adapter, therefore, the integration density is improved over that of the state of the technology.

A further advantage is the ability to contact the switch cabinet externally with ready-made plugs and, at the same time, the ability to provide an individual, functional embodiment of the leadthrough adapter on the rear side of the leadthrough adapter. Hence, the same adapter base model can be used successfully, and in a technically simple and inexpensive manner, in numerous applications.

A further advantage of the invention is that ready-made external lines can be mounted to a likewise ready-made switch cabinet without necessitating the opening of the cabinet. It is also not necessary for the technician to be familiar with the design and interaction of the "insides" of the cabinet, that is, the components housed within it, for connecting the external lines to the cabinet. A further advantage is the high speed permitted by the plug assembly of the external lines in accordance with the invention.

The provision of a front plate on the outside of the switch-cabinet housing notably assures the tight closure of the adapter. The bushings can be mounted directly to the front plate. This embodiment also permits the use of commercially-available, ready-made bushings, and their arrangement in the front plate, behind the openings in the direction of insertion. The bushings and openings are then aligned, so the plugs are inserted into the bushings through the openings. The use of so-called "latch-5 bushings" and correspondingly-embodied "latch-5 plugs" is particularly advantageous. In this instance, the bushings mounted in the adapter on the side of the switch cabinet comprise a bushing housing and a plurality of contact tabs disposed adjacently according to the so-called "latch-5 plug pattern." Contact shoes, whose embodiment complements that of the contact tabs, are disposed in the plug housing having an embodiment that complements that of the bushing housing, so when the plug is inserted, a respective contact shoe is inserted onto a contact tab, thereby producing a line-type connection between bushing contacts, on the one hand, and plug contacts, on the other hand.

To prevent mismatches in the association of individual plugs with individual bushings, a non-interchangeable coding of the plugs and bushings is required. The use of commercially-available contact bushings and a front plate that is provided with holes and is separate from the contact bushings permits the edges of the openings in the front plate to be embodied to partially overlap the bushing inputs. In the regions that overlap the bushing inputs, groove-type recesses are left open; these can have arbitrary cross-section shapes. It is therefore possible to provide dovetail grooves, rounded-out grooves, polygonal grooves, etc. A coding that specifies an individual groove arrangement for each opening, i.e., an opening-specific recess pattern, is especially effective. To complete the coding, ribs or projections embodied to complement the recesses must be provided on the plug housings. It is evident that the embodiment of the projection or rib pattern must be complementary to the recess pattern of the recess associated with the plug. In this way, simple elements effectively prevent a plug from being inserted through a recess into a bushing contact to which it is not supposed to be connected. The mechanical coding can be enhanced by color-coding to facilitate assembly. This can be effected simply by the assignment of a separate color to each opening. The adapter then has a multicolored front plate with different-colored openings. To complete the color-coding, the corresponding connectors are painted in the same color. Finally, it is possible to embody the front plate such that text boxes are provided next to the openings. These text boxes can contain any type of information, for example symbols that also appear on the associated plugs, and therefore constitute a further, separate allocation option. Of course, mechanical coding, like the aforementioned color-coding and/or symbol coding, can also be provided separately. It is therefore not necessary to combine a plurality of coding types. Nevertheless, the mechanical coding discussed above represents a very simple, reliable, foolproof coding, because it precludes erroneous insertion. With the mechanical coding, it is impossible to insert a plug into a bushing contact (behind a recess) to which the plug is not actually supposed to be connected.

It is advantageous to provide a circuit board on the rear side of the adapter. In another advantageous embodiment, a circuit is printed onto the circuit board. Thus, a wide range of circuits can be realized on the leadthrough adapter through a simple exchange of circuit boards with different printed circuits. It is also possible to equip the circuit board with different structural elements for adapting devices that are disposed inside the switch cabinet and standardized for the circuit board. It is further possible to mount actuators or sensors directly on the circuit board, or to provide electrical outputs for actuators or sensors.

Of course, it is especially advantageous to equip the circuit board with connecting elements that are compatible with the plug connections typically provided at the respective actuator or sensor.

The use of a circuit board as stated above thus allows the circuit board to be used as an electrical interface between the "outside world" and the "insides" of the switch cabinet. For this purpose, bushing contacts that are aligned with and preferably behind recesses are connected to the one side of the circuit board, while the opposite side of the circuit board supports connecting elements for the components housed in the switch cabinet. This is especially advantageous because the "plug philosophy" underlying the invention also involves embodying the connecting elements for the "insides" of the switch cabinet as plug connections, for example as keyed plug connectors, flat-line plug-and-socket connectors and also latch-5 plug connectors. Of course, it would also be possible to provide conventional screw terminals on the circuit board. Hence, arbitrary "connector worlds" can be combined with one another according to the invention.

The embodiment of the adapter rear side as a receiving basket takes into account the concept of creating an integral structural element. The connecting elements and the structural elements, including the circuit board, can be held reliably and in a protected manner in the receiving basket. The leadthrough adapter can also be exchanged easily. Hence, different standard models of adapters embodied as an integral structural element can cover numerous applications.

The provision of a sealing bead at the edge of an opening, which simultaneously creates a plug pot for the connector to be inserted, serves a dual function. During the insertion process, the plug pot acts as a guide for the plug. In the plug that is guided, the precise guidance of the plug effectively prevents jamming, which considerably reduces the risk of damage to the plug contacts disposed in the plug, or to the corresponding bushing contacts.

When the plug is inserted, the circumferential sealing bead performs a sealing function, and additionally prevents the intrusion of moisture or foreign objects into the switch cabinet.

In another embodiment, the locking elements, namely the spring hooks mounted at the plug ends, prevent an undesired withdrawal of the plugs from the switching cabinet during operation.

The locking elements are disposed to likewise terminate in the plug pot, so they are inaccessible from the outside when the plug is inserted, thereby precluding an undesired unlocking from the outside or damage to the locking elements from the outside.

The arrangement of further sealing ribs projecting laterally from the plug housing significantly improves the sealing properties of the plug coupling. Whereas, without the sealing ribs, only one sealing plane is present in the transition region between the plug and the coupling in the plug pot, the provision of a plurality of sealing ribs creates a number of sealing planes that corresponds to the number of sealing ribs. The creation of a plurality of sealing planes expands the sealing system of the plug coupling to a sealing labyrinth that particularly effectively prevents the intrusion of small dust particles, as well as moisture.

The mounting of the auxiliary housing around the plug permits the external conductors to be crimped onto their connector contacts, on the one hand, and on the other hand, permits injection-molding around the sides and back of the crimped contacts, so the outside plug housing can be embodied as an injection-molded part. This is favorable from a manufacturing technology standpoint, and, in terms of function, has the advantage that plug housings injection-molded in this manner are particularly well-sealed.

A further embodiment of the plugs that can be inserted into the adapter bushings will be discussed below. Here, the wires of the conductor are preferably connected with quick-connect receptacles. The quick-connect receptacles can be crimped onto the conductors. The conductor wires connected with the quick-connect receptacles are laid in an auxiliary housing. A sealing housing formed from two housing-half shells is then fixed to the end of the auxiliary housing. The actual plug housing is then injection-molded around the sealing housing and the auxiliary housing. An advantage of this setup is that the additional sealing housing that shields the auxiliary housing prevents injection-molding completely around the auxiliary housing. Because no injection-molding material of the outer housing jacket penetrates the auxiliary housing, the quick-connect receptacles are seated to float in the auxiliary housing, which compensates fluctuations in tolerance at the counterconnectors or counterbushings. The effective shielding of the plug housing prior to the injection-molding of the outer housing jacket minimizes the quantity of rejected pieces in production. Finally, fixing the conductors in the auxiliary housing in advance and subsequently mounting the sealing housing also eliminates the theoretical possibility that, with incorrect crimping or unintentional splicing of stranded wires, the stranded wires come so close beneath the surface of the injection-molded jacket that a contact with these voltage-conducting parts lying improperly close beneath the injection-molded jacket may occur during insertion. In this way, a high-voltage test of the individual plugs following the injection-molding around the housing can also be omitted.

Another embodiment of the sealing housing divides the auxiliary housing into two housing-half shells. This is advantageous in terms of production technology. The housing-half shells can have a symmetrical embodiment, so both sides of the sealing housing can be produced with one half-shell model or a single mold.

In another embodiment, the housing-half shells perform a dual function. In addition to their shielding function, they provide strain relief for the finished plug.

In an assembly aid for the adapter according to the invention, pre-locking elements that cooperate with the housing wall are embodied on the adapter. Thus, the adapter can be inserted into its installation opening in the housing wall and pre-locked there. The assembling technician therefore has both hands free to screw the adapter to the housing wall of the switch cabinet. Of course, it is possible to arrange one or more seals between the adapter front side and the housing-wall regions overlapped by the adapter front side.

A primary advantage of the invention is that it permits the adaptation of a switch cabinet having pre-defined "insides" to individual operator requirements merely through the adaptation of the leadthrough adapter to the customer-specific requirements. For example, the bushing contacts on the front plate of the adapter can be adapted to a customer-specific plug pattern. Moreover, functional elements for a customer-specific adaptation of the switch cabinet can be disposed in the receiving basket.

BRIEF DESCRIPTION OF THE DRAWINGS

The invention is described in detail by way of embodiments illustrated in the drawing figures in which.

DETAILED DESCRIPTION OF THE INVENTION

Figure 1:
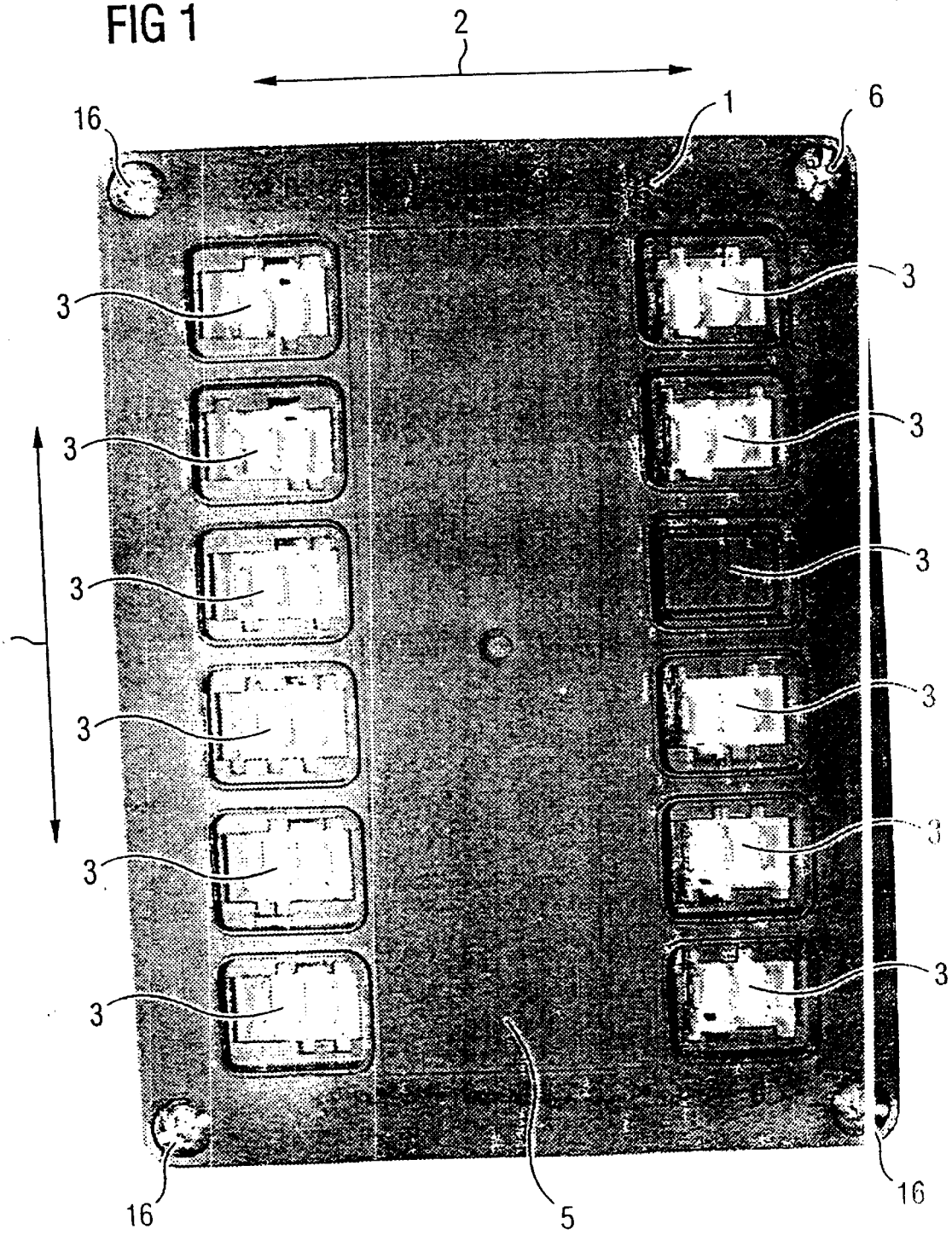
FIG. 1 is a photograph of the front plate of a leadthrough adapter according to the invention.

The front plate 1 of the leadthrough adapter shown in FIG. 1 has two rows of openings 3, which are disposed adjacently in the horizontal direction 2. The openings 3 of each vertical row are superposed in the vertical direction 4. Finally, a text box 5 is disposed between the two rows of openings extending in the vertical direction 4. Furthermore, the front plate 1 has a bore 6 in each corner region for the insertion of an illustrated fastening screw 16. The fastening screws 16 fix the leadthrough adapter 1 to a switchgear cabinet 34 (see FIG. 5B) or a housing wall 35 of the switchgear cabinet 34.

Figure 2:
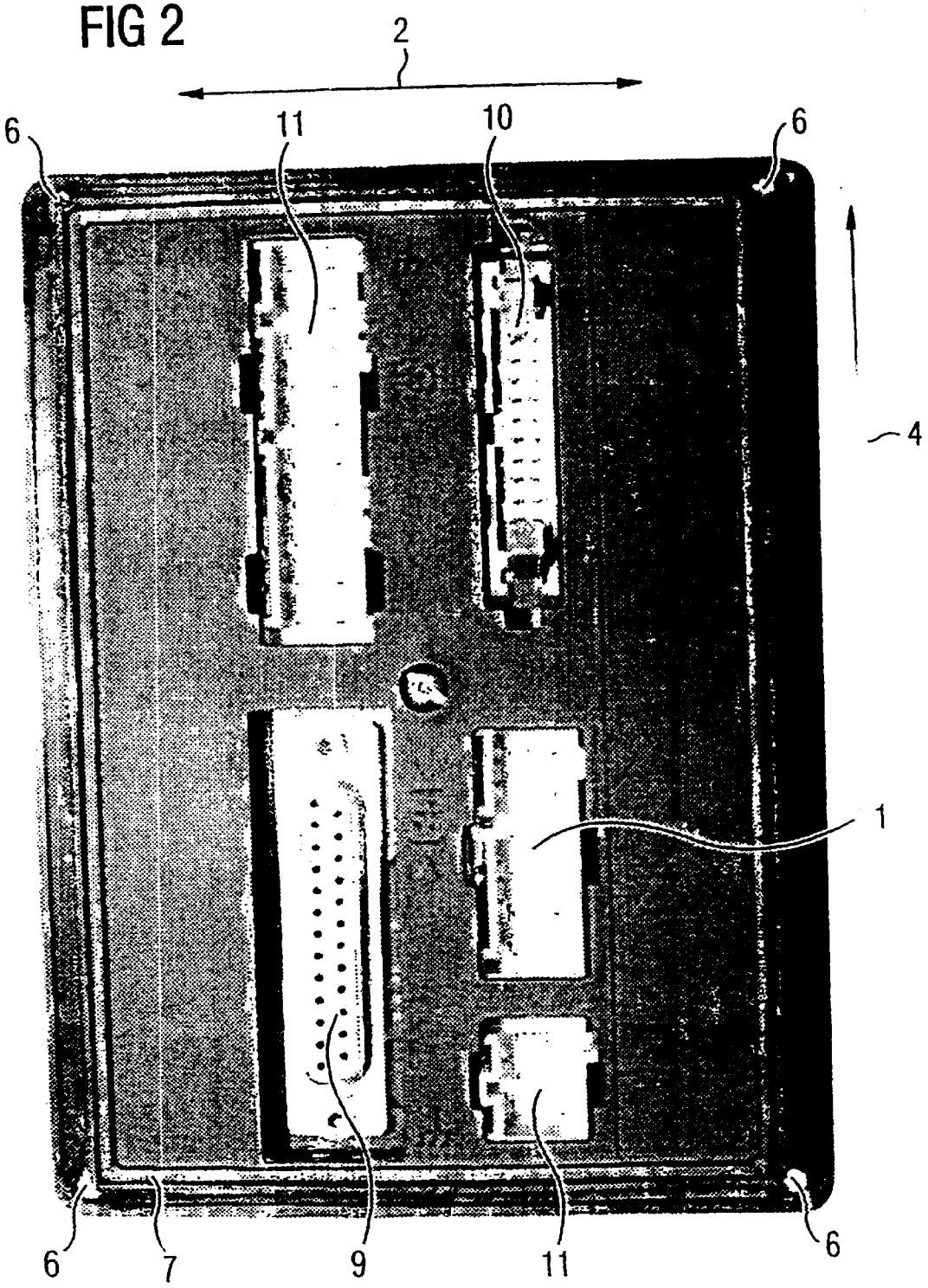
FIG. 2 is a photograph of the rear side of a leadthrough adapter according to the invention.
Figure 3:
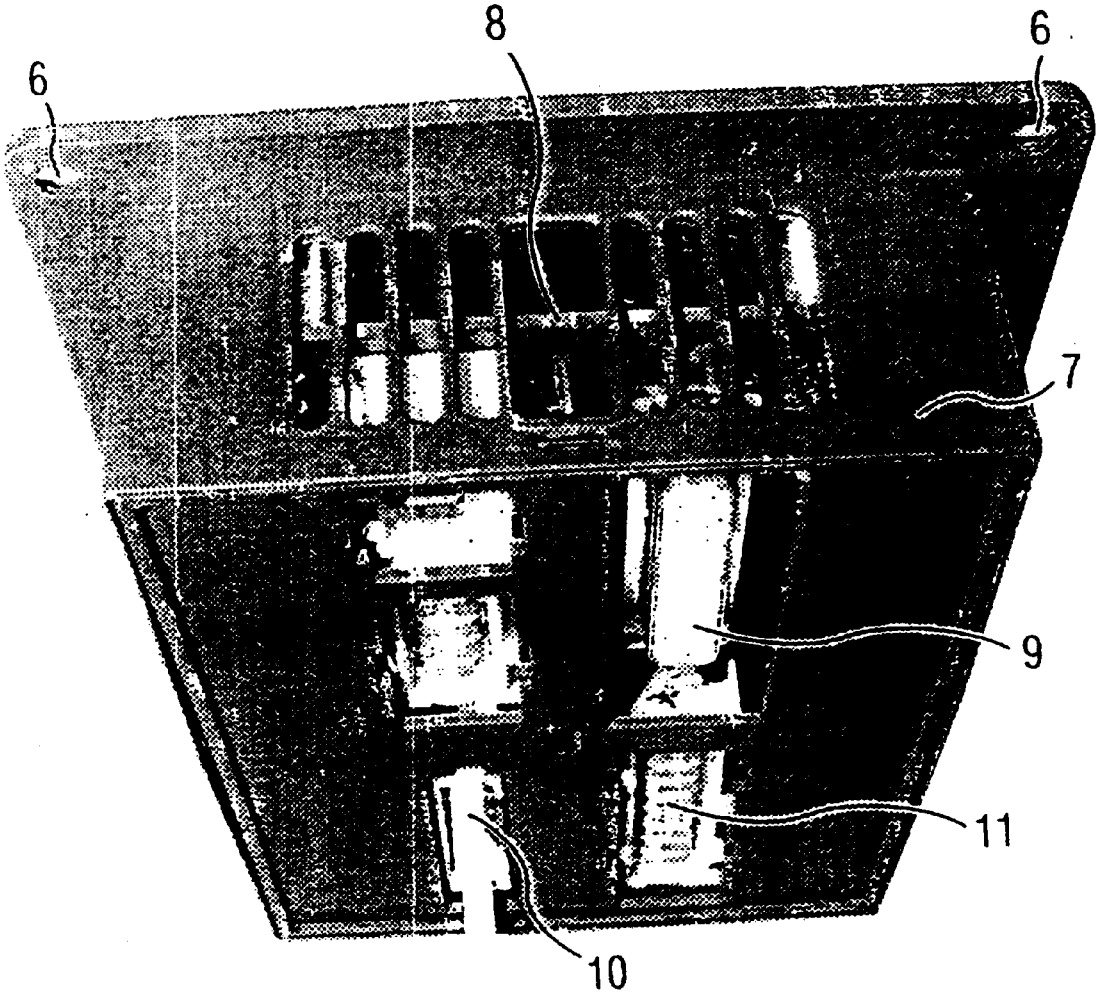
FIG. 3 is a photograph taken from the side into the receiving basket of the leadthrough adapter according to the invention.
Figure 4:
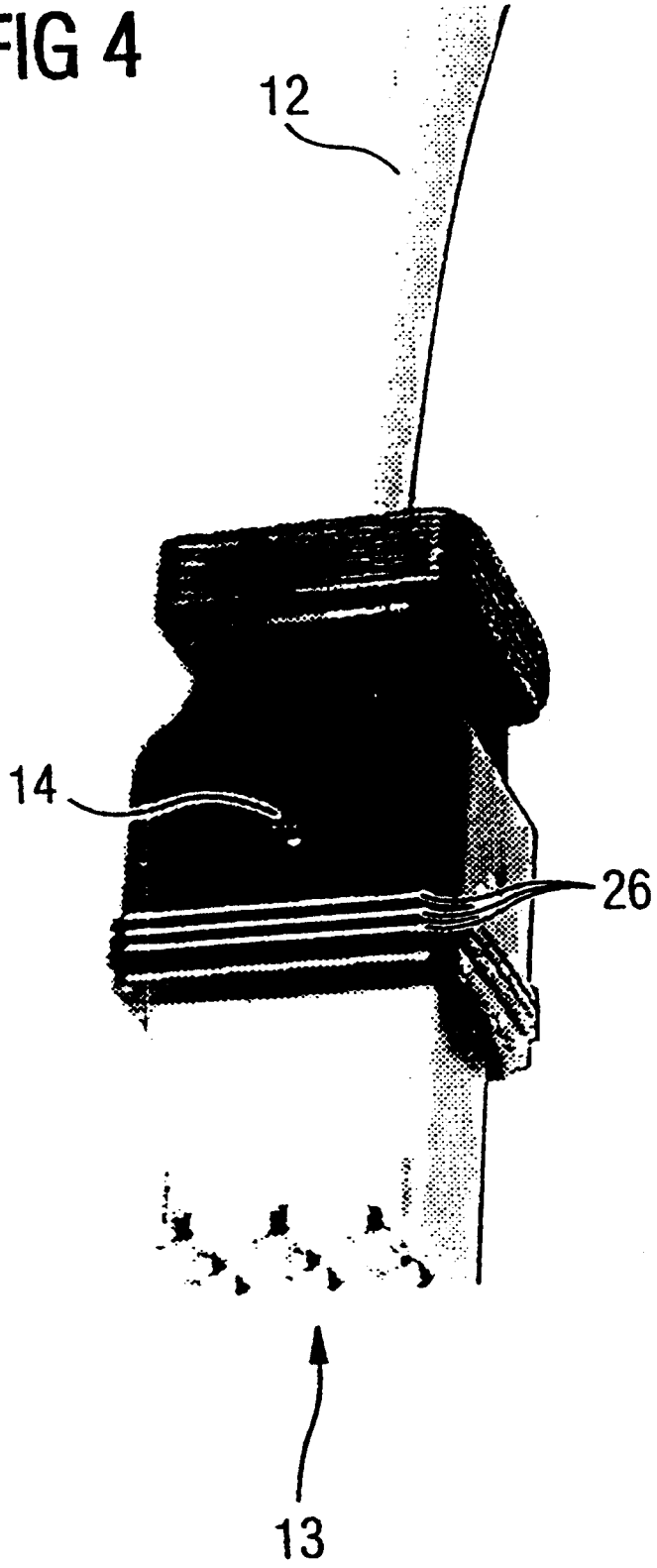
FIG. 4 is a photograph of a plug whose embodiment is compatible with that of the leadthrough adapter.

In the final assembly stage, the receiving basket 7 projects from the adapter rear side into the switch cabinet (FIG. 2). The circuit board 8 is disposed in the receiving basket 7. A keyed bushing 9, a plug connector having contact pins 10 and three so-called latch-5 bushings of varying size are mounted to the circuit board 8.

A plug 13 is connected, ready-made, to a respective external line 12. The plug 13 has an injection-molded plug housing 14 with sealing ribs 26 formed onto it.

Figure 5A:
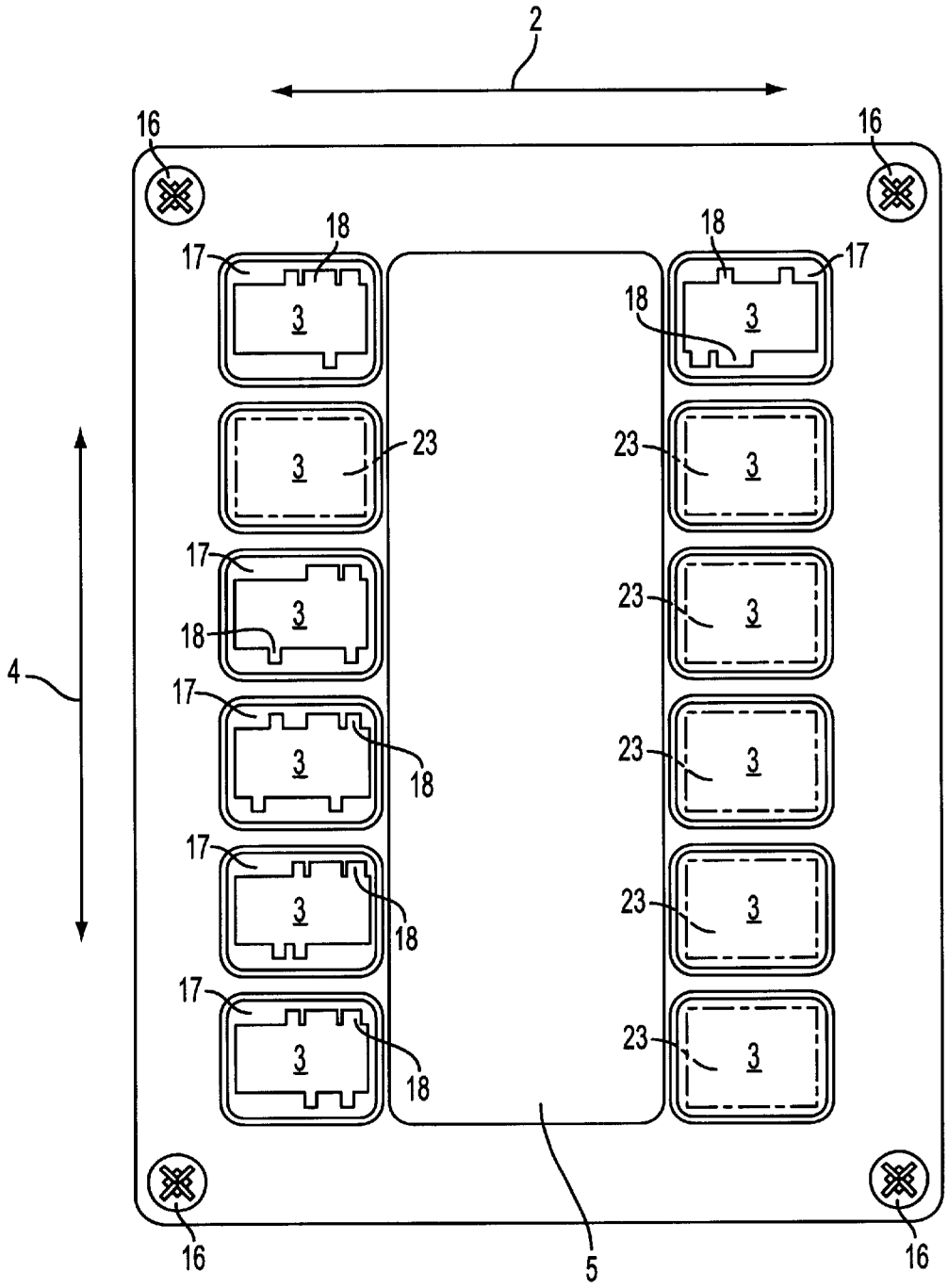
FIG. 5A is a plan view of the front plate of a first embodiment of the adapter, having six openings with bushings that end flush with the openings.
Figure 5B:
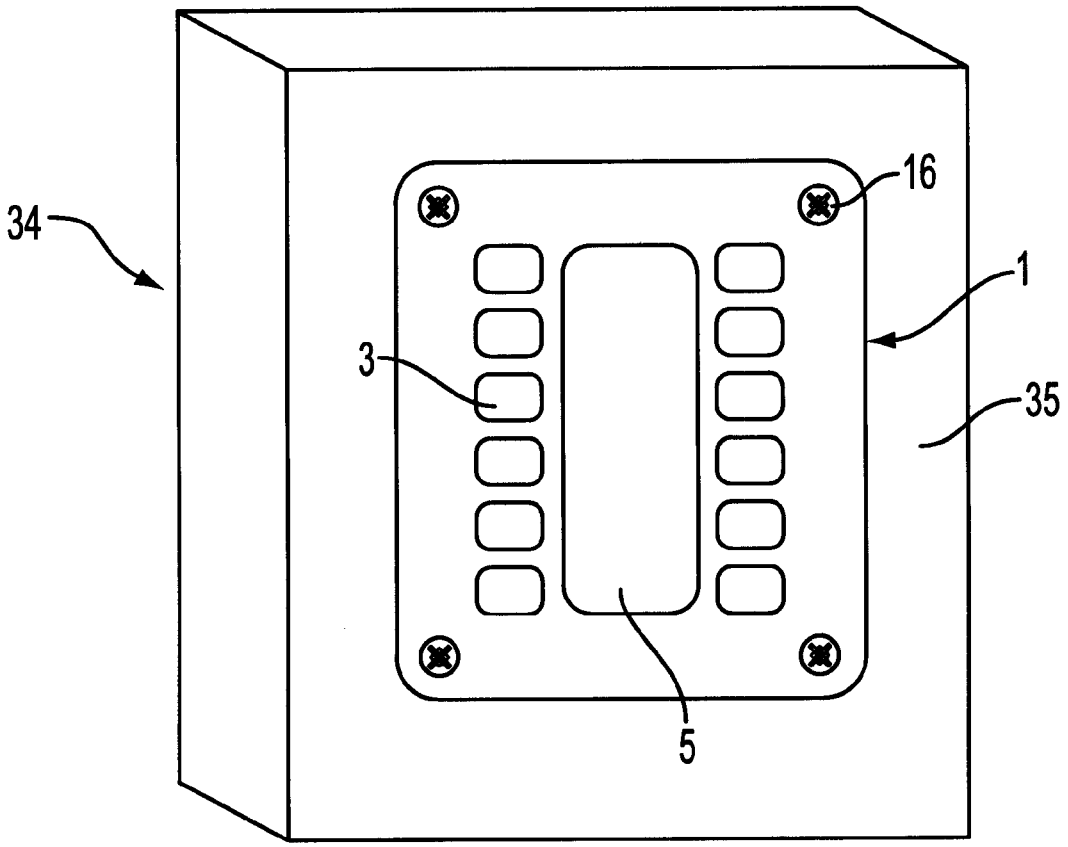
FIG. 5B is a perspective view of a switchgear cabinet with a leadthrough adapter, similar to that of FIG. 5A.
Figure 6:
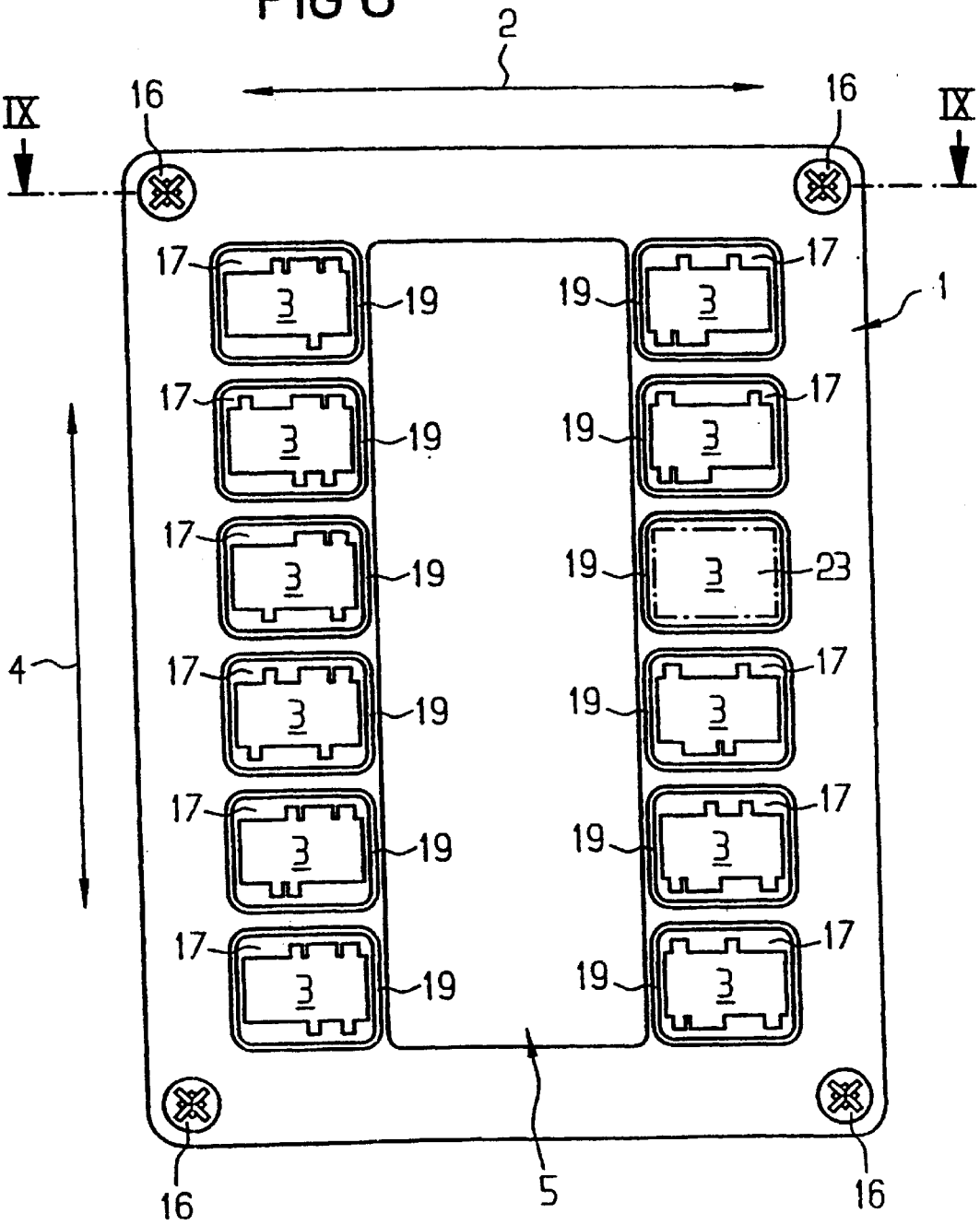
FIG. 6 is a view of a further embodiment of the leadthrough adapter that includes only one closed opening, the view corresponding to FIG. 5A.

The Phillips-head screws 16, with which the front plate 1 of the adapter is fixed to the switch cabinet 35—shown in FIG. 5B of the drawings—are visible in the representation of FIG. 6. The Phillips-head screws 16 are inserted through the bores 6.

Figure 7:
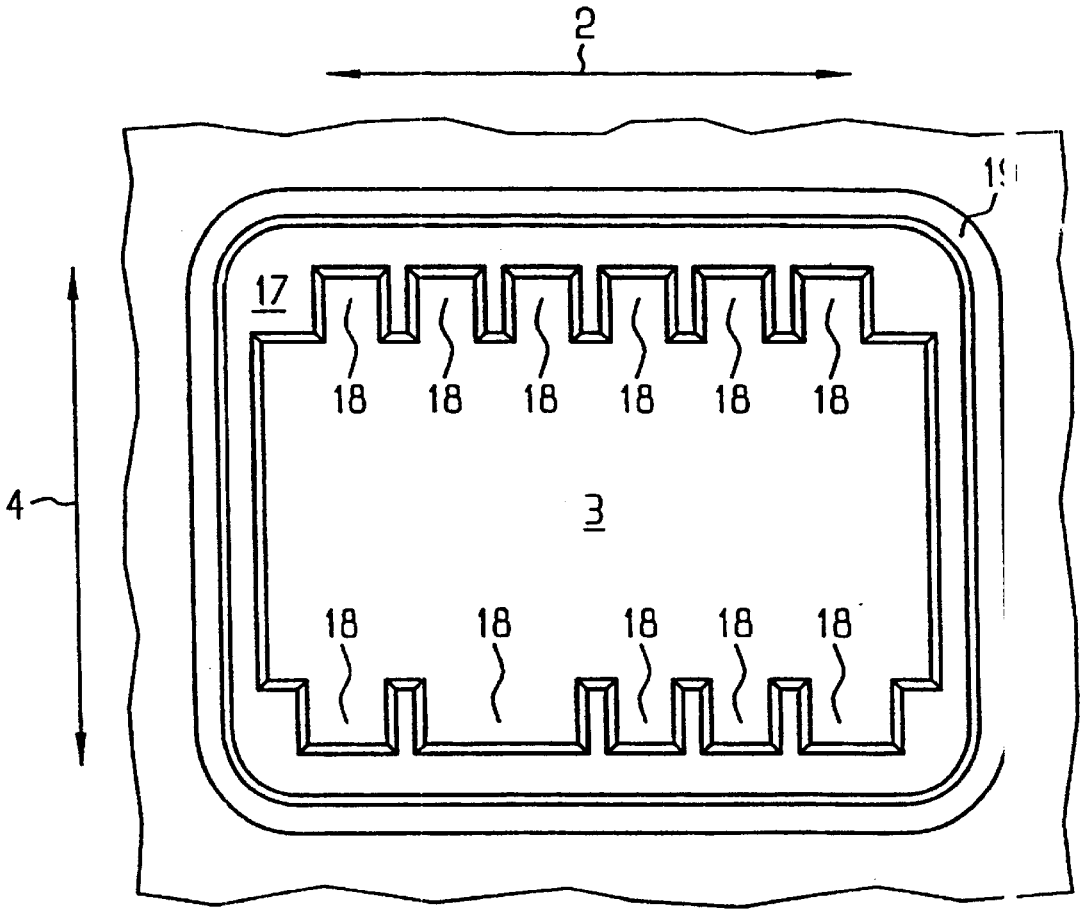
FIG. 7 is a detailed view of an opening having a predefined coding pattern.

The openings 3 have edges 17, which project in the drawing plane defined by the horizontal direction 2 and the vertical direction 4. Recesses 18 are left open in the edges 17 to form an individual coding pattern for each opening 3. As can be seen clearly in FIGS. 5 and 6, the individual openings 3 have different coding patterns, namely recesses 18 at different locations. As can be seen clearly in FIG. 7, the individual recesses 18 can have different dimensions, and can vary in geometry. The invention permits an infinite number of different codings.

The regions of the edges 17 that are not interrupted by recesses 18 serve simultaneously as the floor of the plug pots disposed upstream of the individual openings 3. The collars 19 form the walls of the plug pots. The collars 19 respectively frame an opening 3. Each collar 19 projects from the adapter front plate, and thus out of the drawing plane of FIGS. 5A, 6 and 7, in the counter-insertion direction 20, i.e., perpendicular to both the horizontal direction 2 and the vertical direction 4. The plug bushings 22 are embodied, aligned with and behind the openings 3, in the insertion direction 21 opposite the counter-insertion direction 20, which also extends perpendicular to both the horizontal direction 2 and the vertical direction 4. The plug bushings 22 in the illustrated embodiment are configured as so-called latch-5 bushings. An uncoded plug bushing 22 is therefore disposed behind each coded opening 3.

Depending on the desired embodiment, it is, of course, also possible to leave one or more openings 3 unoccupied—in other words, not to provide any plug bushings 22 behind an opening 3. In this instance, the openings 3 are simply sealed against the outside by a closing plate 23. In the embodiment shown in FIG. 6, the third opening 3 from the top in the right vertical row of openings is unoccupied. The embodiment shown in FIG. 5A indicates that the second opening 3 from the top in the left vertical row is unoccupied, and is closed by a closing plate 23, while, with the exception of the uppermost opening 3 in the right vertical row, all further openings 3 are closed by a mounted closing plate 23, and thus are inoperative.

Figure 10:
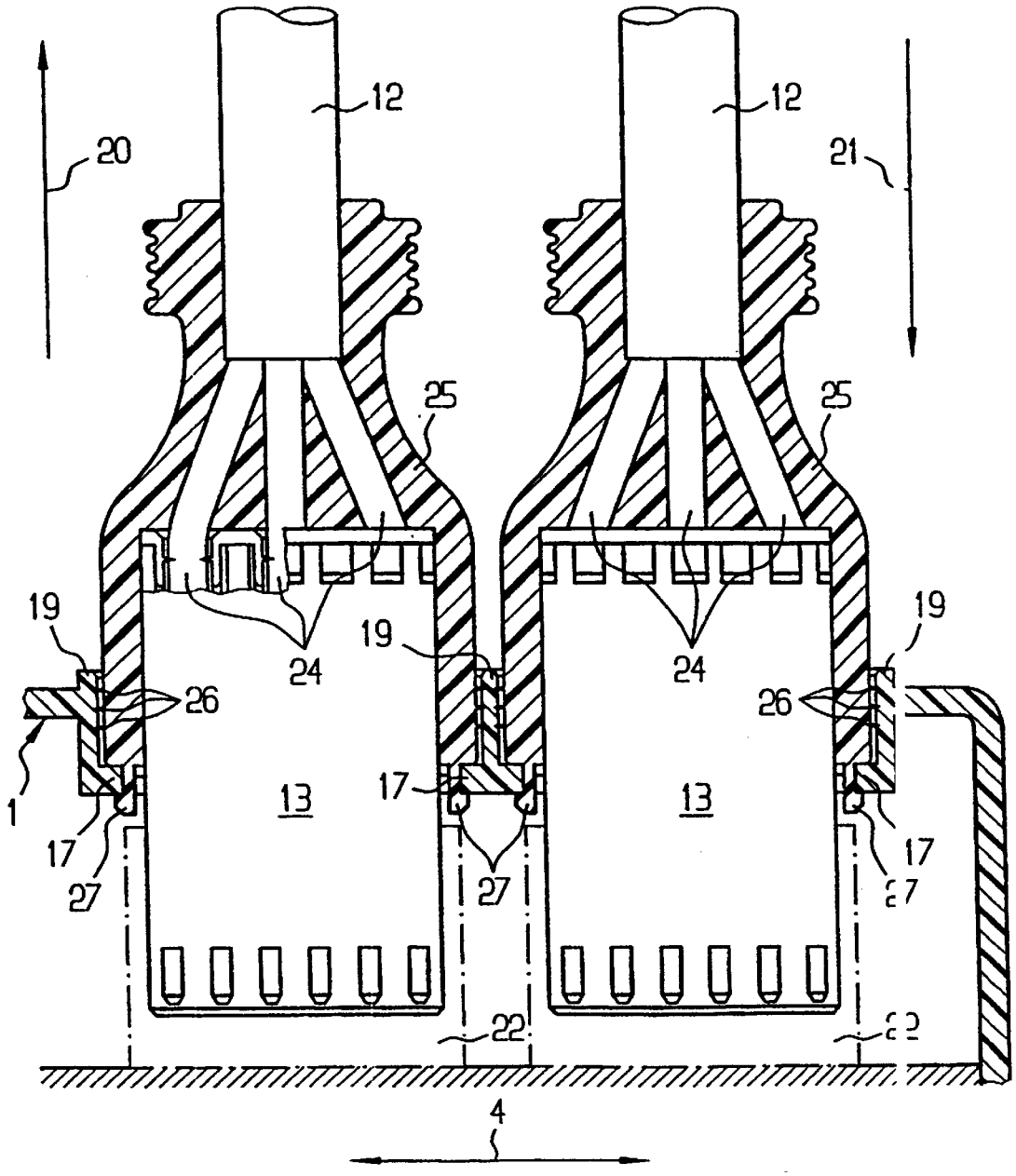
FIG. 10 is two adjacent coupling regions having inserted plugs, in a horizontal section.

To connect the external lines 12, contact shoes are crimped onto the individual conductors 24 of the external line 12. These contact shoes are seated in the plug housing. The housing that forms the actual plug region of the plug housing is first closed from behind by a lid to form an auxiliary housing. The actual plug housing, namely the bulkhead housing 25 in FIG. 10, is then injected onto the sides and back of this auxiliary housing. The bulkhead housing 25 protects the plug 13 against external influences, and ensures that a switch-cabinet housing equipped with the adapter of the invention attains the degree of protection IP 54 in accordance with EEC 529.

It can further be seen from FIG. 10 that the additional sealing ribs 26 are disposed on the bulkhead housing 25 of the plugs. The sealing ribs 26 rest laterally against the collars 19 or the side walls of the plug pot in a sort of frictional lockup, thereby forming a sealing labyrinth with three sealing planes in the illustrated embodiment. Finally, the spring hooks 27 project from the plug ends of the bulkhead housing 25 of the plugs 13, in the insertion direction 21. When the plug 13 is inserted, the hook claws of the spring hooks 27 hook behind the edges 17 of the opening 3 associated with the corresponding plug bushing 22 for additionally latching the plugs 13 in the front plate 1 of the adapter.

Figure 11:
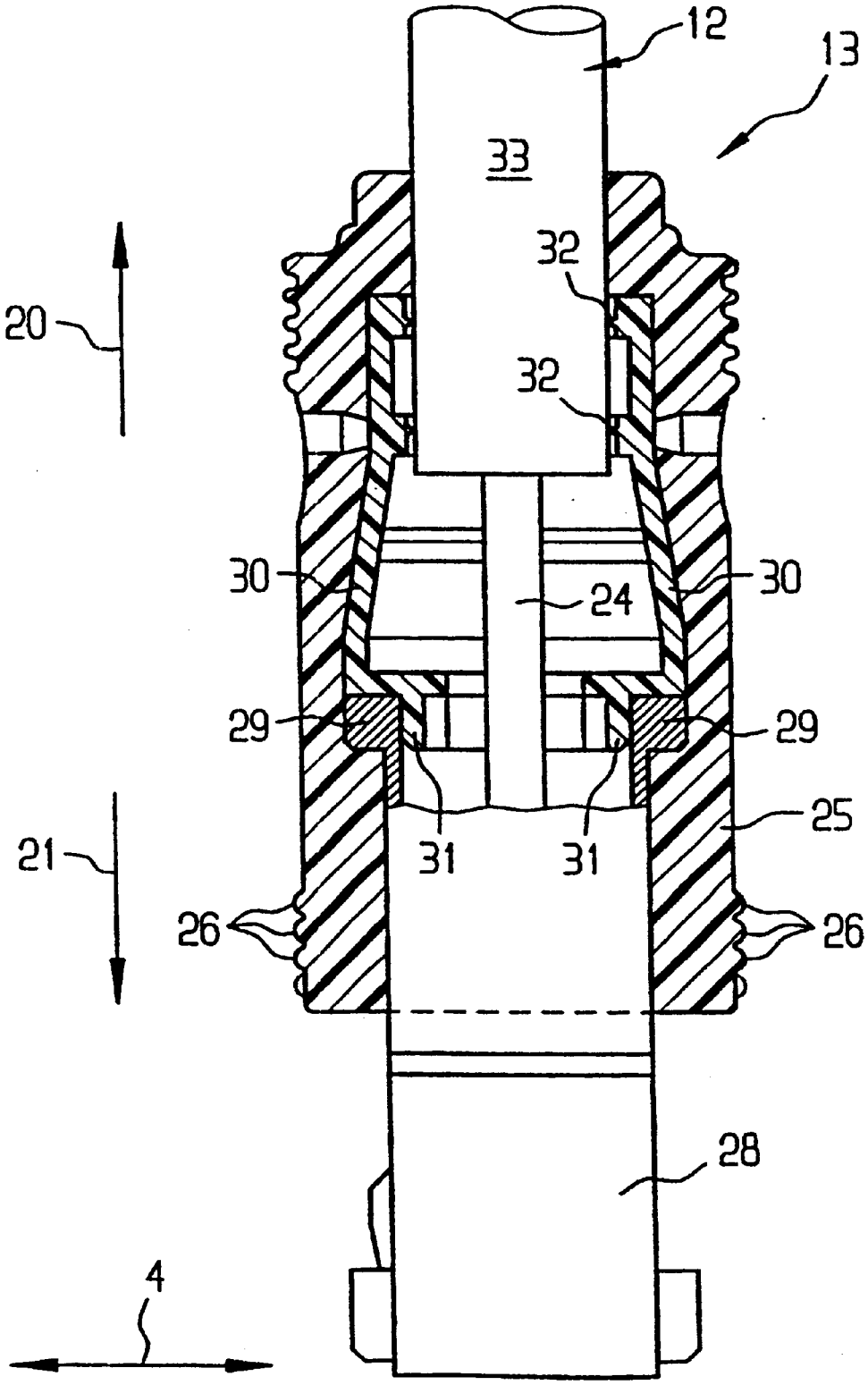
FIG. 11 is a vertical section of a plug having an auxiliary housing and a sealing housing.

FIG. 11 illustrates a modified embodiment of the plug 13. In this modified embodiment, the auxiliary housing 28 forms the actual plug region of the plug. The conductors 24, which are preferably connected with quick-connect receptacles, are laid into the auxiliary housing 28. The quick-connect receptacles are laid in pockets of the auxiliary housing 28 that have a complementary embodiment. The quick-connect receptacles and the conductors 24 laid inside them are seated to float to some extent inside the auxiliary housing 28, which assures a certain tolerance compensation relative to the contact tabs to be connected to the quick-connect receptacles in the latch-5 bushings 11 during insertion. The two half shells 30 are inserted onto the rear wall 29 of the auxiliary housing 28. In the illustrated embodiment, the two half shells 30 have an identical embodiment, and are reversed by 180° relative to one another. In the final state of assembly, the half shells 30 form the sealing housing shown with thin-line hatching in FIG. 11.

Fixing latches 31 project out of the half shells 30 in the insertion direction 21. These fixing latches 31 extend behind the rear wall 29 of the auxiliary housing 28. The fixing latches 31 that extend behind the edge of the auxiliary housing 28 form a guide for the half shells 30. For assembly, the conductors 24 connected to the quick-connect receptacles are inserted into the aforementioned pockets of the auxiliary housing 28. The half shells 30 are then inserted, with their fixing latches 31 forward, onto the edge of the auxiliary housing 28, and are pivoted toward one another, so they cover and completely shield the conductor 24 between themselves.

At the ends remote from the fixing latches 31, the half shells 30 are provided with two semicircular-notched ribs 32. The ribs 32 contact the insulating jacket 33 of the external line 12, or the insulating jacket 33 for the conductor 24, when the half shells 30 are mounted. In the final state of assembly, the ribs 32 are tensed relative to one another in the manner of clamping jaws. The ribs 32 therefore form the partial region of the half shells that effects strain relief for the plug 13 in the final state of assembly. At the end located in the region of the ribs 32, the half shells 30 have form-fit elements for a form-fitting latching of the two half shells 30.

The pre-assembly of the plug 13 is ended when the conductors 24 are laid in the auxiliary housing 28, as described, and the two half shells 30 are latched together. In a final production step, the sealing housing formed by the two housing-half shells 30 is injection-molded around entirely, and the auxiliary housing 28 positioned in front of the sealing housing, when seen in the insertion direction 21, is injection-molded around partially, to form a bulkhead housing 25 for the plug 13. The primary advantages of this embodiment are the floating seating of the plug contacts of the conductors 24 for tolerance compensation in the bulkhead housing 25, and the strain relief for the plug that is provided by the ribs 32.

Figure 8:
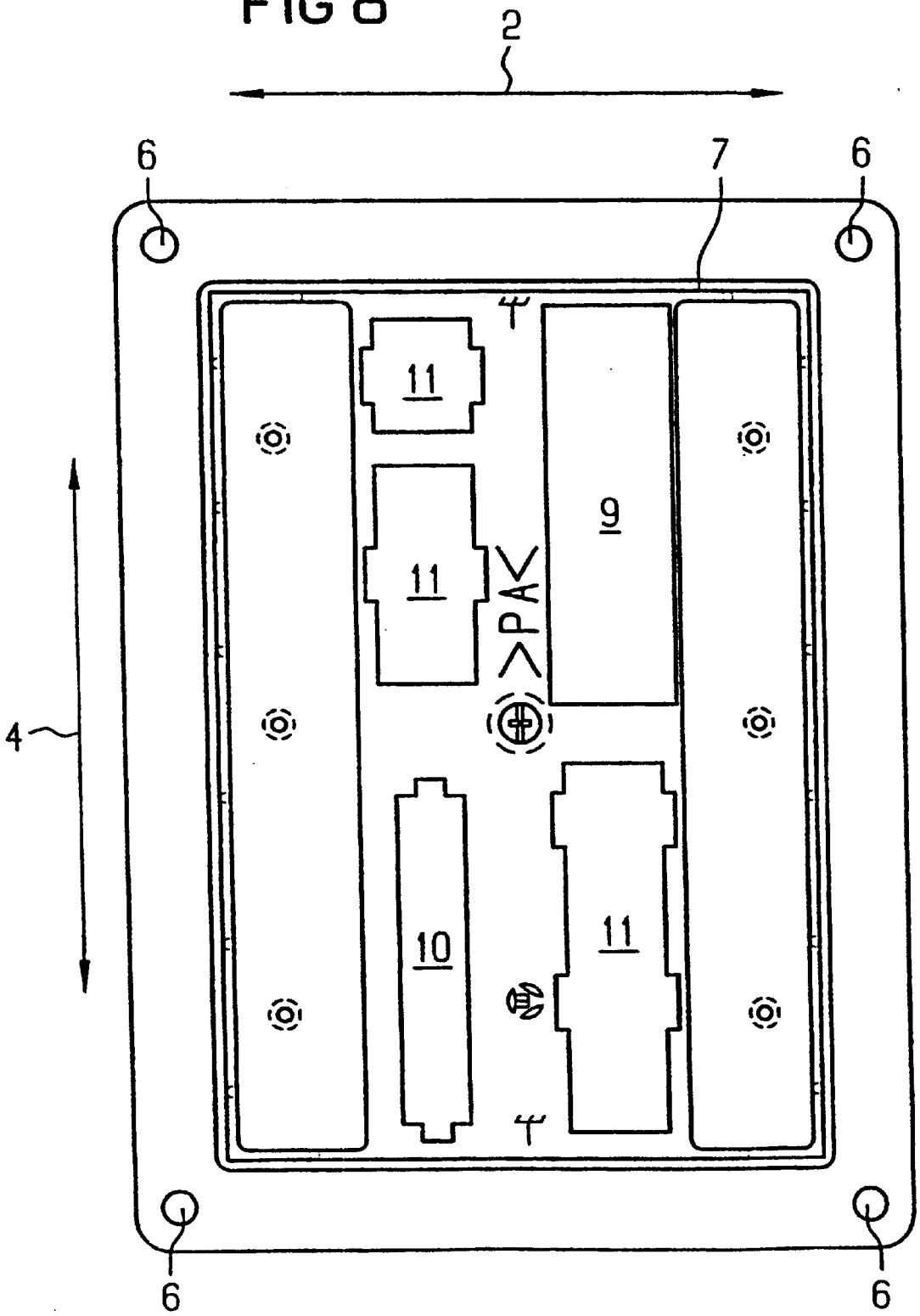
FIG. 8 is a plan view of the adapter rear side.
Figure 9:
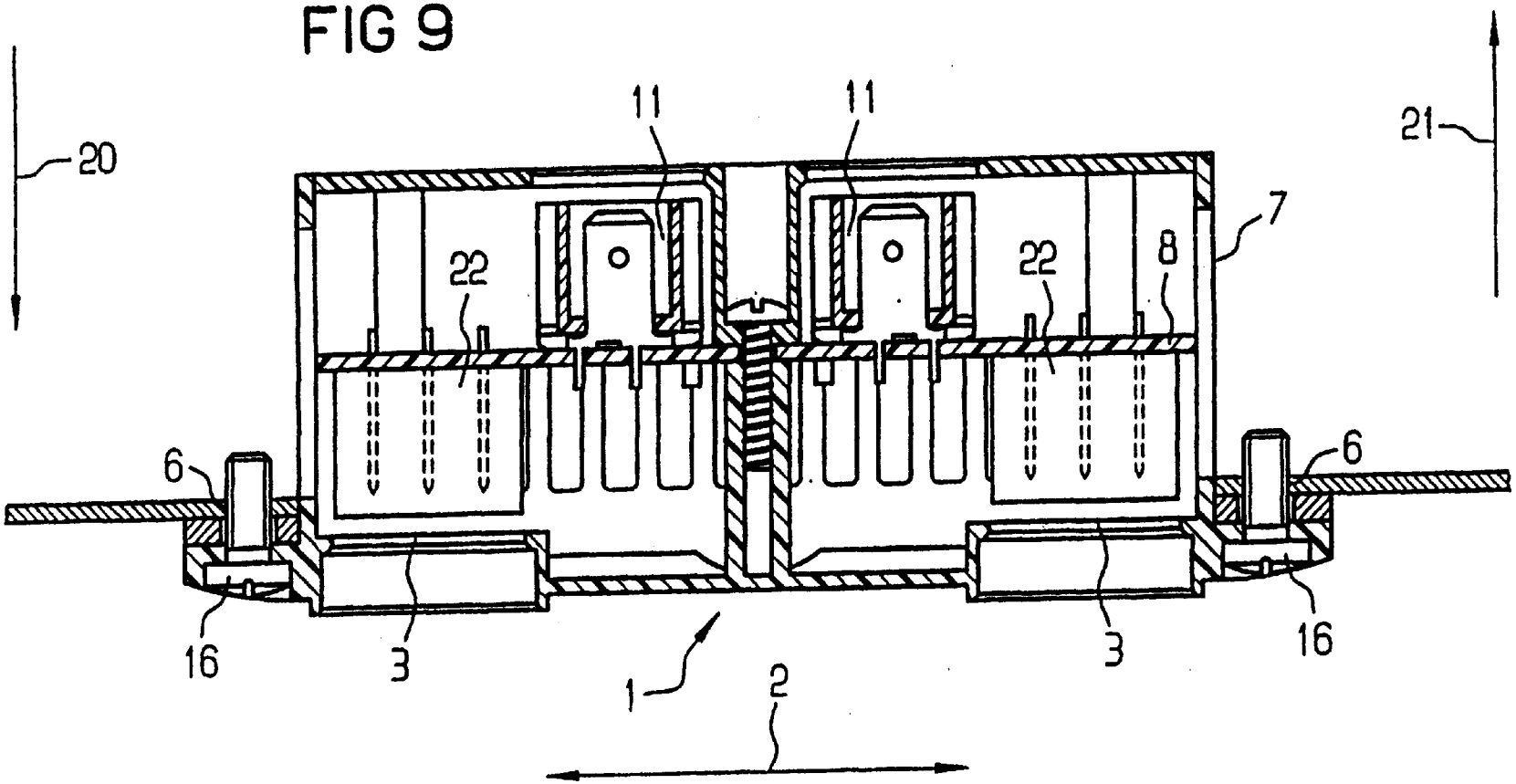
FIG. 9 is a side view, in a vertical section, of the adapter.

As described above, the receiving basket 7 is embodied on the adapter rear side facing away from the front plate 20 in the counter-insertion direction 20. In the illustrated embodiment (FIG. 9), the circuit board 8 acting as the carrier for the functional parts is disposed in the receiving basket 7. On the side of the circuit board facing the front plate 1, the plug bushings 22 are fixed to produce contact. In FIG. 9, two latch-5 bushings 11 are disposed on the rear side of the circuit board facing away from the front plate 1 in the insertion direction 21. FIG. 8 shows an arrangement in the receiving basket 7 that corresponds to the representation of FIG. 2.

What is claimed is:

1. A switch cabinet having a leadthrough adapter that is disposed in a housing wall, having at least one bushing that is or are located on a front side of the adapter, which is accessible from the outside of the cabinet, the at least one bushing serving to receive plugs that are connected to external electrical lines and can be inserted into the at least one bushing, wherein electrical connecting elements for components housed inside the switch cabinet are disposed on a rear side of the adapter facing the inside of the cabinet, characterized in that the connecting elements have different plug-and-socket connectors for connecting the components disposed inside the switch cabinet and a front plate is mounted on the outside of the housing wall of the switch cabinet, said front plate having openings, which are aligned with the at least one bushing and correspond in number to the at least one bushing, where each opening has differently configured recesses formed into the edges of the openings for individual mechanical coding of each opening.

2. The switch cabinet according to claim 1, wherein the plug-and-socket connectors are selected from the group comprising: keyed connectors, flat-line plug-and-socket connectors and latch-5 connectors.

3. The switch cabinet according to claim 1, wherein the leadthrough adapter has electrical or electronic structural elements.

4. The switch cabinet according to claim 3, wherein the electrical or electronic structural elements are selected from the group comprising devices for voltage supply or signal conversion, and display or separating elements.

5. The switch cabinet according to claim 3, wherein the electrical or electronic structural element is a circuit board.

6. The switch cabinet according to claim 5, wherein a circuit is printed on the circuit board.

7. The switch cabinet according to claim 5, wherein the electrical connecting elements are disposed on the circuit board.

8. The switch cabinet according to claim 5, wherein the at least one bushing is disposed on the circuit board.

9. The switch cabinet according to claim 1, wherein a receiving basket is embodied on the rear side of the adapter for receiving the electrical connecting elements and the structural elements.

10. The switch cabinet according to claim 1, further comprising a collar framing a respective opening and projecting from the front plate, said collar acting as a sealing bead in that the collar and the edges of the openings, which are provided to varying degrees with recesses, form a plug pot for the guided reception of the plug to be inserted.

11. The switch cabinet according to claim 10, further comprising at least one sealing rib, which projects laterally from a plug housing, and is supported with their end faces against the inside of the collar when the plug is completely inserted into the bushing for an additional, frictional-type seal of the plug pot against the environment.

12. The switch cabinet according to claim 1, wherein the plugs inserted into the at least one bushing are equipped at the plug ends of their plug housings with one or more spring hooks, and the spring hooks extend behind the edge of the associated opening when the plug is completely inserted into the bushing (22) for a form-fitting latching of the plug to the adapter front plate.

13. The switch cabinet according to claim 1, wherein contact elements of the plug are crimped onto conductors laid in an auxiliary housing that is closed from the rear by a lid, and the auxiliary housing is injection-molded around on the sides and rear to create a sealed plug bulkhead housing.

14. The switch cabinet according to claim 13, further comprising a bulkhead housing for the plug that includes the auxiliary housing, which holds the contact elements and forms a plug end of the finished plug, a sealing housing that is fixed on the rear side of the auxiliary housing, and an injection-molded covering of a sealing material.

15. The switch cabinet according to claim 14, wherein the sealing housing comprises two housing-half shells that are latched together.

16. The switch cabinet according to claim 15, wherein partial regions of the housing-half shells rest against the insulating jacket of a conductor in the manner of clamping jaws, and fix the conductor between themselves to provide strain relief for the plug.

17. The switch cabinet according to claim 1, wherein the adapter can be inserted into a housing-wall opening of the switch cabinet that is adapted to the adapter's outer dimensions, and pre-locking elements are embodied on the adapter as assembly aids for fixing the adapter in its final assembled position.

* * * * *